US005348399A

United States Patent [19]

DeMatteis

[11] Patent Number: 5,348,399

[45] Date of Patent: Sep. 20, 1994

[54] PLASTIC BAGS WITH WAVEFORM EDGE CONFIGURATIONS

[76] Inventor: Robert B. DeMatteis, 800 E. Washington, Colton, Calif. 92324

[21] Appl. No.: 995,369

[22] Filed: Dec. 23, 1992

[51] Int. Cl.[5] ..... B65D 30/00

[52] U.S. Cl. ..... 383/209; 206/554; 221/63

[58] Field of Search ..... 206/554; 383/209, 35; 221/45, 63

[56] References Cited

U.S. PATENT DOCUMENTS

| | | | |
|---|---|---|---|
| Re. 34,019 | 8/1992 | Kuklies et al. . | |
| 144,238 | 11/1873 | Stow | 383/35 |
| 185,469 | 12/1876 | Arkell | 383/35 |
| 186,009 | 1/1877 | Jordan et al. | 383/35 |
| 2,349,369 | 5/1944 | Norseen | 383/209 |
| 2,541,674 | 2/1951 | Snyder | 383/209 |
| 2,679,351 | 5/1954 | Soffa . | |
| 3,269,593 | 8/1966 | Lodewick et al. . | |
| 3,395,830 | 8/1968 | Buttery . | |
| 3,420,433 | 1/1969 | Bostwick . | |
| 3,451,453 | 6/1969 | Heck . | |
| 3,548,723 | 12/1970 | Sengewald . | |
| 3,624,791 | 11/1971 | Taub . | |
| 3,760,940 | 9/1973 | Bustin . | |
| 3,765,565 | 10/1973 | Fietzer et al. . | |
| 3,881,632 | 5/1975 | Early et al. . | |
| 3,986,479 | 10/1976 | Bonk . | |
| 4,044,919 | 8/1977 | Olson . | |
| 4,175,673 | 11/1979 | McDonald et al. . | |
| 4,363,405 | 12/1982 | Christie . | |
| 4,401,427 | 8/1983 | Benoit et al. . | |
| 4,453,649 | 6/1984 | Origuchi . | |
| 4,506,801 | 3/1985 | Origuchi . | |
| 4,526,291 | 7/1985 | Margulies . | |
| 4,562,938 | 1/1986 | Loder . | |
| 4,567,984 | 2/1986 | Gietman, Jr. . | |
| 4,586,630 | 5/1986 | Loder . | |
| 4,759,639 | 7/1988 | DeMatteis . | |
| 4,765,508 | 8/1988 | Poppe . | |
| 4,769,125 | 9/1988 | Roen et al. . | |
| 4,769,126 | 9/1988 | Roen et al. . | |
| 4,805,800 | 2/1989 | Nocek et al. . | |
| 4,811,418 | 3/1989 | Reifenhauser . | |
| 4,877,335 | 10/1989 | Barnard . | |
| 4,911,561 | 3/1990 | Wagner . | |
| 5,024,349 | 6/1991 | Haenni et al. . | |

FOREIGN PATENT DOCUMENTS

| | | |
|---|---|---|
| 1433433 | 6/1966 | France . |

*Primary Examiner*—Stephen P. Garbe
*Attorney, Agent, or Firm*—Darby & Darby

[57] ABSTRACT

The bags may be sculptured with a wave pattern defin- the mouth of the bag. The bags may be secured to two tabs which are connected to the corner regions via the wave pattern, which is perforated. By attaching the tabs to a carton and pulling the bag, the bag severs cleanly from the tabs at the waveform perforation.

4 Claims, 3 Drawing Sheets

PLASTIC BAGS WITH WAVEFORM EDGE CONFIGURATIONS

BACKGROUND OF THE INVENTION

1. Field of the Invention

The present invention relates to plastic bags of the type suitable for use in retail, supermarket, and foods outlets, and other related applications.

2. Discussion of Related Art

Conventional plastic bags are of a flush-cut type, which has been commonly used for the past 10–15 years to hold merchandise or food items as is found, for instance, in retail stores, bakeries, supermarkets or hot dells in a foods outlet.

Years ago, before the strong presence of plastic in such outlets, common paper bags were used as the principle packaging means. These bags were typically "baled" in units of about 500. The outlet using the bag would generally place these bags, stacked one upon the other, on a shelf near a cash register at the check-out counter. When the consumer made a purchase, the clerk would close the sale and then place the consumer's purchase in the paper bag.

With the recognition by retailers of the many great attributes and versatility of plastic, including the availability in many colors and with a substantial space savings, more and more retailers began to switch from paper bags to plastic. Unfortunately, plastic bags could not be stacked one upon the other due to their slippery nature. When dispensed from the counter in this manner, they would frequently slide onto the floor, and hence be thrown away in the trash.

To help overcome this problem, dispenser cartons were designed with simple, square openings in the front panel of the carton. The user could slip his hand inside the square opening on the carton and withdraw a plastic bag through the opening in the same natural motion as with paper. This carton prevented the naturally slippery bags from sliding onto the floor. These bags in dispenser cartons serviced the industry for several years and usually with a specific cost benefit per unit over paper.

In an effort to reduce costs of cardboard cartons and to reduce throwaway trash in a retail operation, several plastic bag producers began to offer dispenser bags to replace the dispenser carton. These bags typically had a square hole in the front part of the dispenser bag. Typically, the plastic bags were dispensed from the dispenser bag in much the same manner as from the dispenser carton.

However, close observation of dispensing bags from a traditional dispenser box or dispenser bag with the square hole in the front reveals another problem. The problem is that as bags are withdrawn from the dispensers, frequently more than one bag would be extracted by the user. This is due to a few factors. One is the natural tendency of thin gauged plastic bags to stick together, one to another, due to static electricity. Another is that during the manufacturing process, the bags are frequently stacked one upon the other on pins, hence creating a tendency for the stack of bags to stick together. The phenomena is further compounded when a manufacturer very tightly packs the dispenser box with bags, pushing the bags together and further enhancing the sticking problem.

When a plastic bag is dispensed from a dispenser box or dispenser bag, it is a common phenomena to accidently extract more than one bag at a time. The result of this phenomena is that the extra extracted bags frequently end up being pushed underneath, and to the back, of the check-out counter. Wastage can be substantial.

One method used to help overcome this problem was to pack the bags in the dispenser with the bottoms (bag tails) towards the square opening. This helps to some extent because the user can more easily locate a single bag tail to withdraw. This means of packing bags was only partially effective in reducing wastage upon dispensing. It did, however, create a new problem that is probably more costly to the retail outlet.

If the bags are packed "tail forward", a user requires 4–5 motions to dispense and open the bag. In contrast, if the bags are packed "mouth forward", a user can dispense and open the bag in 1–2 motions. The extra motions associated with the bags packed "tail forward" constitute extra handling required to reposition the bag favorably with the bag mouth upwards to prepare the bag for opening and loading.

With the high cost of labor in developed countries, these added time consuming steps represent a potentially substantial amount in labor costs as well as a decrease in productivity and customer through-put. Thus, packing the bags tail forward has its drawbacks.

Another potential solution to the bag dispensing problem is putting bags on rolls. However, this approach, while reducing the wastage from bags sticking together, creates a worse productivity picture. The motions required to withdraw and remove a bag from a roll generally number about 7–9. The added motions are required to tear a bag from the roll, then reposition it for opening.

Other approaches to overcoming the bag sticking problem and the dispensing problem are such as those bags of U.S. Pat. No. 4,759,639. These dual tab bags, when dispensed from a carton which retains the dual tabs, have a reliable degree of singulation. This means of mounting the tabs on a tab retention device in the carton packing operation has been relatively costly and labor intensive.

A perforation typically used in a bag tab configuration is that described in U.S. Pat. No. 4,759,639. This bag style, when pulled from its tabs, may be vulnerable to tearing at the perforation connection areas. To alleviate this tearing problem, an upwardly pointing tit connection may be provided which causes the tear to be directed into the tab region and away from the bag body. While such a tit connection does tear into the tabs rather than the bag, it leaves unsightly tails attached to the bag. At times, the tit connection may cause tearing across the entire tab, leaving unsightly plastic pieces remaining attached to the bag body.

It would be desirable to provide plastic bags so as to reduce the problems of wastage and loss of productivity associated with the use of flush-cut plastic merchandise bags in retail and supermarket outlets. It would also be preferable to increase the likelihood of a clean cut when severing perforations between a plastic bag and its tab.

SUMMARY OF THE INVENTION

An aspect of the invention is directed to a sculptured plastic bag having a mouth opening into which may be inserted items to be held by the bag, the bag having two edge configurations which extend from opposite sides of said opening, each of said two edge configurations having a wave pattern of a series of peaks and valleys. This wave pattern may resemble a sawtooth pattern, a sinusoidal pattern or a scalloped pattern.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

The phrase "sculptured" plastic bag is intended to refer to a type of plastic bag which has a mouth with a top edge at the top, a tail at the bottom, two sides extending from the tail to an elevation lower than the top edge of the mouth, and two edge configurations each extending from the top of a respective one of the sides to the top edge. The two edge configurations are an extension of the mouth since there are no upper shoulders at the same elevation of the top edge of the mouth.

Figure 1:
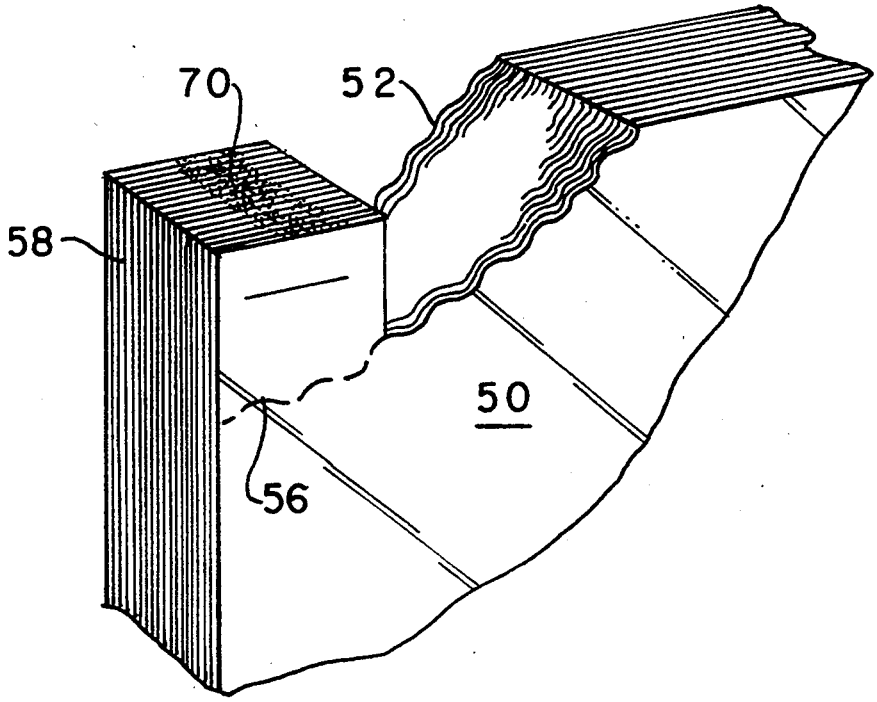
FIG. 1 is a perspective view of the embodiment of a sculptured plastic bag with attached end tabs provided.

As can be better seen in FIG. 1, two edge configurations 52 (only one depicted in FIG. 1 for the sake of brevity), each extend from a respective side of the top straight edge 53 of the mouth of the sculptured bag are each sculptured or cut with dies to have a wave form out, resembling either a scallop, saw tooth or sinusoidal pattern. Each sculptured edge configuration generally curves downwardly and outwardly to a respective side of the bag. Spaced from and between these sculptured edge configurations may be an oval opening which will serve as a handle, and which is spaced from the top straight edge of the mouth opening. Such oval openings are known.

Figure 2:
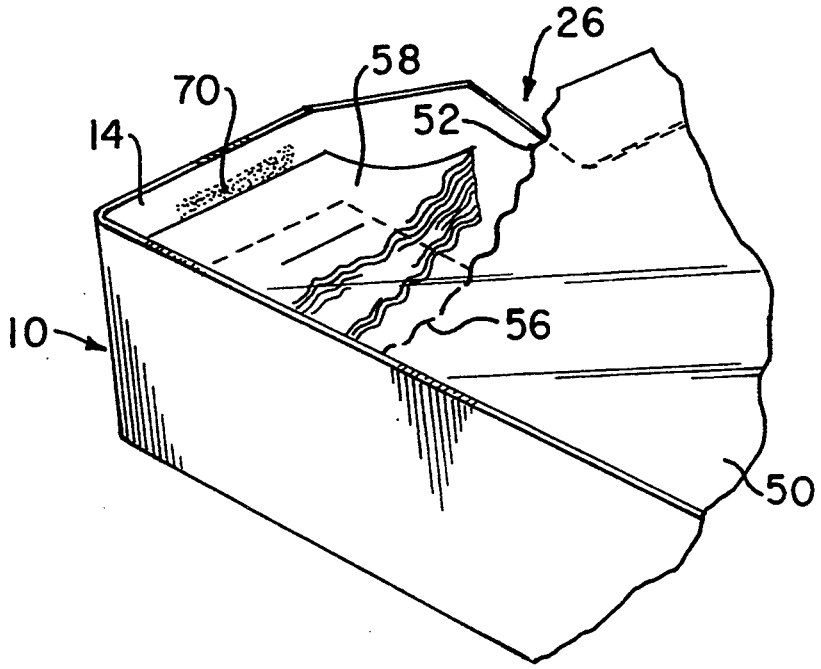
FIG. 2 is a partially broken view of the plastic bags of FIG. 1 contained within a carton, but with the tabs secured to an inside surface of the carton and with an upper tab severed from its associated top-most bag which results from pulling the top-most bag out of the carton.

FIG. 11 depicts the upper left side of a dual tab perforations 56 are provided which separate tabs 58 from the rest of the bags. These perforations 56 are cut as a continuation of the scallop shape and, when the bag is pulled out of a dispensing carton will sever as shown in FIG. 2. Examples of suitable perforating rules include any from 2 teeth per inch to 12 teeth per inch or with a tooth size of from 1/32 inch to $\frac{1}{2}$ inch with a 1/32 inch to $\frac{1}{8}$ inch spacing between adjacent teeth.

On a top edge of the stacked tabs 58 is an adhesive 70, such as an epoxy or hot melt. As can be seen best in FIG. 2, this adhesive 70 is pressed against an inner facing side of the front surface 14 of the carton 10 to securely adhere the tabs to the carton. FIGS. 1 and 2 only show the upper left hand side of the stack of bags; the upper right hand side is configured as a mirror image of the upper left hand side.

When pulling the top-most one of the bags 50 through the cut-out 26, the perforations 56 at both the upper left and right hand sides sever, leaving the top tabs adhered to the carton. When dispensing the bag by pulling it through the cutout 26 of FIG. 2, the scalloped shape contributes to the dispensing of the bags one at a time.

The scalloped cut of the sculptured bag of FIG. 1 may be formed by using a metal rule material, such as that manufactured by U.S. companies of Helmold, Simonds or Wagner. This material is then shaped into an appropriate die shape, such as may be done by Dietec, Inc. of Chicago, Ill. Once the die is made, the bags are cut in accordance with a conventional die cutting process, such as that which utilizes a Universal Cutting Table as made by Amplas, Inc. of Green Bay, Wis. or by a clicker press such as that manufactured by H. Schwabe, Inc. The die consists of sharp metal blades formed and inserted in a wooden board.

Examples of suitable wave rules for cutting the wave form shape of sculptured bag include the $1\frac{1}{2}$ point coarse angle, 2 point scalloped wave rule, and 2 point coarse wave rule as manufactured by J. F. Helmold, Inc. Other examples are a 2 point coarse edge wave rule as provided by Simonds and, for smaller sculptured bags, a 2 point medium edge rule cut as provided by Simonds. Further examples are the 0.937 inch high 2 point coarse, the 0.937 inch high 3 point medium, and the 0.937 inch and $1\frac{1}{8}$ inch high 3 point fine edge wave rule as provided by Wagner. This list of examples is not intended to be exhaustive or to limit the invention to these specific examples.

When wave rule is used with tabbed sculptured bags, the lighter the film gauge of the high density film to be cut, the more important it is to have a narrower gap between perforations. Without a sufficiently narrow gap, the thin gauge film will follow the path of least resistance during separation of the bag from the tab, which may result in a straight line tear. The preferred gap distances are as follows: for gauges of about 0.00045 to 0.00065, a gap of 0.32; for gauges of about 0.00065 to 0.001, a gap of 0.45; and for gauges above 0.001, a gap of 0.60.

The wave frequency obtained will fall into one of three categories: under 2 waves per inch (low), 2 to $3\frac{1}{8}$ waves per inch (medium), and $3\frac{1}{8}$ to 6 waves per inch (high). As a general rule, the higher the frequency of the wave rule pattern, the narrower the spacing between adjacent teeth. For medium wave frequency, the same preferred spacing distances apply as mentioned previously for the different gauges, except that for the Simonds 2 point medium coarse, a spacing of 0.45 for, 0.00065 to 0.001 gauge and a spacing of 0.60 for over 0.001 gauge is preferred. For high wave frequency, 0.32 spacing is preferred for all gauges or even a smaller spacing may be used for gauges 0.00045 to 0.001. For low wave frequency, 0.38 spacing is preferred for 0.00045 to 0.00065 gauge; 0.52 spacing is preferred for 0.00065 to 0.001 gauge and 0.7 spacing is preferred for gauges over 0.001.

The wave rule for cutting the wave form pattern may be a double-sided blade with each side sharpened, as in the case for the previously mentioned Helmold wave rules. Two modifications of this wave rule blade are depicted as embodiments in FIGS. 15, 16 and 17, 18.

A comparative study of the sculptured bag embodiment has been conducted, that is, for bags with and without the scallops. The phrase "singulation" refers herein to the desired goal of dispensing the bags one at a time.

The scallops on the sculptured has provide a scalloped effect which tends to cause the bag to stick to (snag on) the carton dispenser opening, and hence channel forward and upward into the slits. As a result, the scalloped effect promotes singulation.

In contrast, where the sculptured bag has a smooth cut (a smooth curved cut in place of a scalloped cut), the bag tends not to snag as well. As a result, there is a tendency for the thin plastic film to "fold over" without channelling through the slits; hence there is less tendency for bag singulation.

There are two other attributes to the scalloped effect. The "snagging" effect improves the likelihood of the bag mouth to open up upon being dispensed. This is virtually non-existent without the scallop effect.

Another benefit of the scalloped effect is it aids in preparing the "next bag" for future dispensing. This too is virtually non-existent with a smooth sculptured bag.

Bags were tested with a very high degree of static electricity which would magnify significantly the ensuing sticking problem caused by the static electricity (e.g., static cling). Such a sticking problem would ordinarily be lessened under proper manufacturing procedures.

All of the following bags tested were the same light gauge (0.00045) bags, containing approximately the same very high degree of static electricity. This causes a high degree of cling and a tendency of the bags to want to adhere to one-another. Tabulated in the test results are the number of dispenser failures and the number of bags dispensed as a result of the failures.

Three types of bags, put up in six combinations were tested. They were conventional flush top bags, sculptured bags, and dual tab sculptured bags fixed inside the carton of the embodiment of FIG. 2. The sculptured bags with scalloped shoulders are those of the type shown in FIGS. 1 and 2. The sculptured bags with smooth shoulders are similar except that the wave form edge configuration 52 of FIGS. 1 and 2 is replaced by a smooth curve. The results are set forth in Table I below.

TABLE I

| BAG STYLE | In Percentages: MULTIPLE BAGS No. DISPENSED | OCCURRENCES |
|---|---|---|
| A. * Control carton (flush top prior art bags). | ** | ** |
| B. Conventional flush top bag. | 68.8 | 25 |
| C. Sculptured bag with smooth shoulders. | 36 | 20 |
| D. Sculptured bag with scalloped shoulders. | 30.8 | 15.4 |
| E. Dual tab Sculptured bag (smooth) fixed inside carton. | 33.4 | 16.7 |
| F. Dual tab Sculptured bag with scalloped shoulders. | 26 | 13 |

TABLE I-continued

* The control carton used standard flush top prior art bags in its standard carton size.
** Too difficult to assess. Repeated attempts resulted in quantities of as many as 26 bags stuck together on a single dispensing. Although these bags were put back in and tried again, there was only limited success in dispensing a single bag at a time.

The results from these tests indicate:

The scalloped effect on the sculptured bag improved dispensing further. It reduced the number of multiple bags erroneously dispensed by 14.4% and lowered the number of occurrences by 23%.

The use of dual tabs improved the dispensing another 10–20% when the tabs of the bags were affixed inside the carton corners.

Dispensing of the sculptured bags from conventional cartons (lacking slits) was tested and the results are in Table II below.

TABLE II

| BAG STYLE | MULTIPLE BAGS # DISPENSED | OCCURRENCES |
|---|---|---|
| G. Sculptured bag in carton without slits. | 93.1% | 20% |
| H. Sculptured bag in a carton with a Sawtooth cut-out but w/o the channeling effect or Slit. | 50% | 18.1% |
| I. Dual tab dispensed from carton without slits. | 41.8% | 16.3% |

* Sculptured bags had the wave pattern scallop.

These test results tend to show that the sculptured bag with the wave pattern improved dispensing in conventional cartons (without the slits) over conventional bags without the sculptured wave pattern. At least there were a few bags that dispensed singly in the conventional carton, but the cut-out opening on the conventional carton does nothing to promote singulation of the dispensing.

However, the snagging effect by the sculptured bag with the wave pattern on a conventional carton without slits, but with a sawtooth opening added in accordance with the invention, did help. The bags snagged better than the conventional bags without the sculptured wave form. In this test, the carton did not have slits and its side edges did not incline outwardly to provide a channeling effect.

The dual tab bags in a prior art carton dispensed at about the same incidence level as a dual tab bag in the carton of the present invention, but the number of multiple bags dispensed increased.

Figure 3:
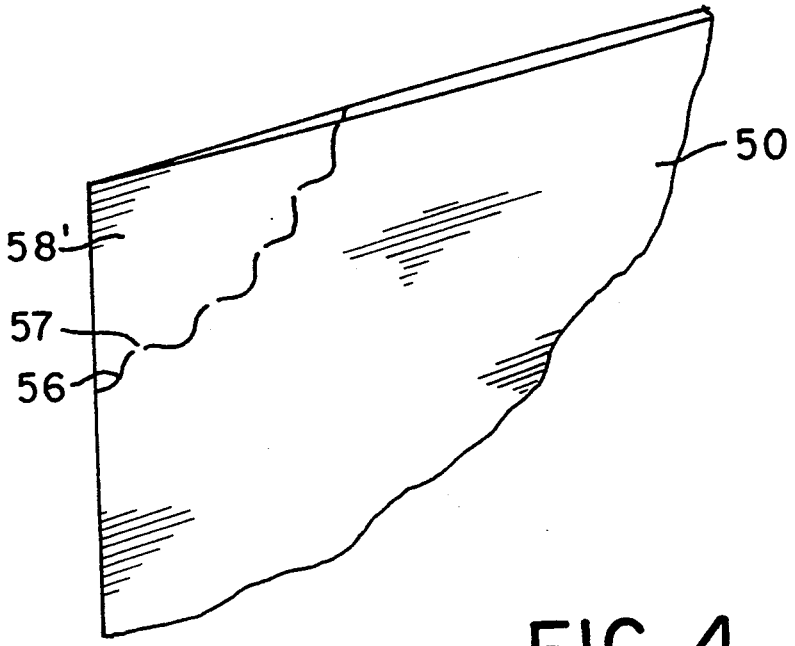
FIG. 3 is a partial perspective view of an upper left corner area of a plastic bag in accordance with another embodiment of the invention, which mirrors the upper right corner area of the bag and is similar to the embodiment of FIG. 1.
Figure 4:
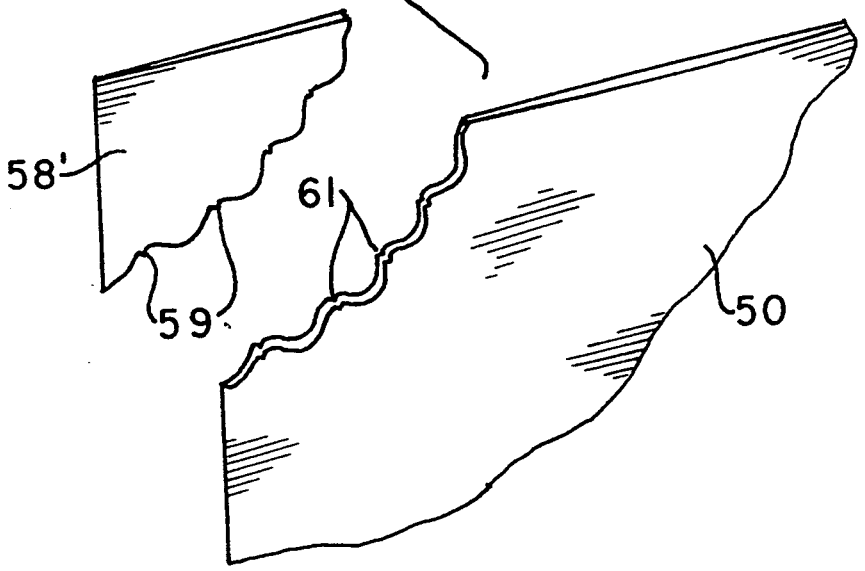
FIG. 4 is a partial perspective view of the same view as FIG. 3 except after severing the upper left corner tab from the rest of the bag.

FIGS. 3 and 4 are successive views showing the result of pulling off a plastic bag from its corner tabs by tearing its perforated wave form pattern. The result is a sculptured bag with a two edge configurations each being clean cut and having a wave form with peaks and valleys. The edge configurations extend from a top edge of the mouth to respective sides of the bag.

When dispensing one bag at a time from a stack of bags, pulling each bag off from corner tabs 58' (FIGS. 1 and 2) helps to ensure that only one bag is taken at a time. The perforated wave pattern of peaks and valleys separates the tab 58' from the rest of the bag. This pattern consists of perforations 56 and tit connections 57 at the apex of the peaks and may be a sine wave pattern, a saw tooth pattern or a scalloped pattern. After severing the wave pattern perforations, these tit connections appear as small nibs 59 or small recesses 61.

When the bag 50 is pulled relative to the tabs 58', the tit connections 57 sever, thereby leaving each tab 58' separated from the bag 50 in the manner generally shown in FIG. 20. This severing takes place directly across the peaks with little chance of tearing into the bag 50 or upwardly into the tab 58'. As such, the cut is relatively 'clean' so that after severing, no unsightly tears or tails appear attached to the bag.

Conventional tabs are attached to bags by a perforated curved line extending from each end of a bag mouth to a respective side of the bag. When the bag is pulled with respect to the tabs, the perforated curved line severs, leaving the tabs separated from the rest of the bag. Unfortunately, the severing is not always clean.

Instead, the bags or tabs are vulnerable to tearing or ripping at the perforation connections. Even if tit connections are provided between the perforations which point upwardly towards the tab and thereby prevent tearing or ripping of the bags, the severing at the perforations still may leave unsightly tails extending upwardly where the tab used to be. In some cases, pulling the bag from the tabs so as to sever at the perforations may even tear up the entire tab leaving pieces of unsightly plastic from the tab still attached to the body.

Figure 5A:
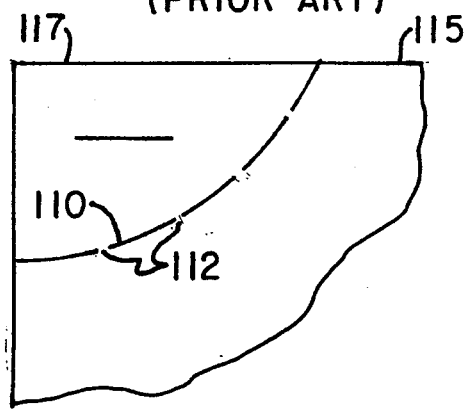
FIG. 5a (PRIOR ART)
FIG. 5*a* is schematic representation of a conventional plastic bag with perforations between a tab and the rest of the plastic bag.
Figure 5B:
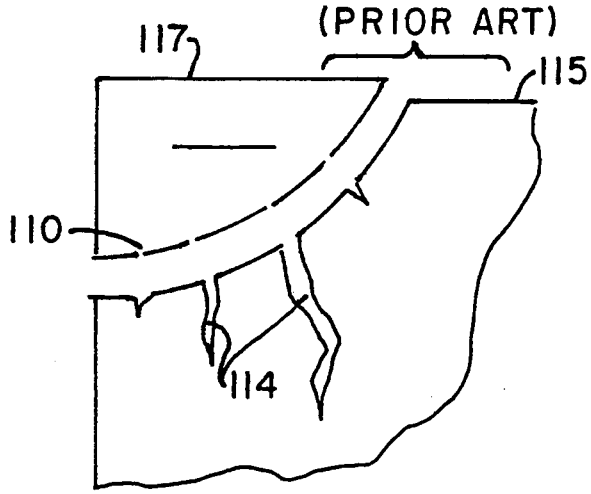
FIG. 5b (PRIOR ART)
FIG. 5*b* is a schematic representation of the plastic bag of FIG. 6*a* after severing the perforations.
Figure 6A:
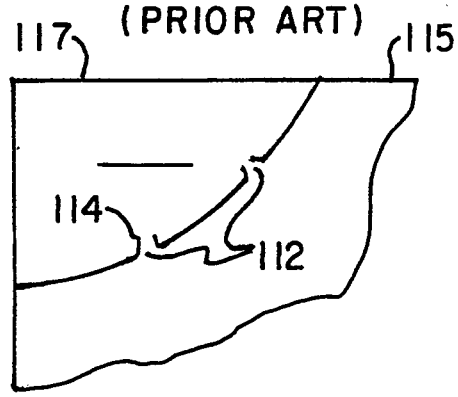
FIG. 6a (PRIOR ART)
FIG. 6*a* is a schematic representation of another conventional plastic bag with perforations between a tab and the rest of the plastic bag.
Figure 6B:
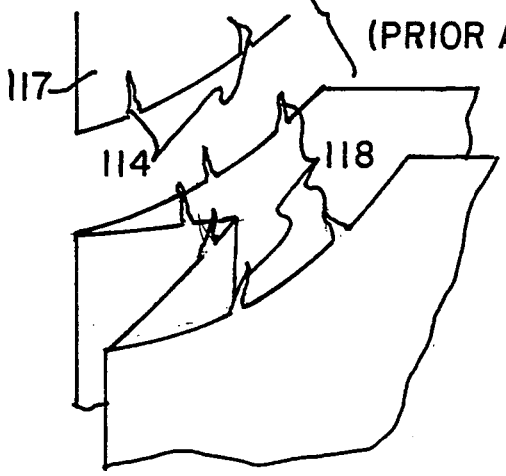
FIG. 6b (PRIOR ART)
FIGS. 6*b*, 6*c* are different schematic representations of the plastic bag of FIG. 6*b* after severing the perforations.

As illustrated in FIGS. 5*a*, 5*b* and 6*a*, 6*b*, 6*c* one can see the consequences of leaving perforated connections vulnerable to tearing. FIGS. 5*a*, 5*b* show the perforation line 110 which has vulnerable points 112, i.e., those most susceptible to tearing in an unclean manner in the form of tears 114 into the bag 115 itself. FIGS. 6*a*, 6*b* show a conventional modification with upwardly pointing tit connections 116 which ensure that the tears 114 are into the tabs 117 rather than into the bag itself.

Figure 6C:
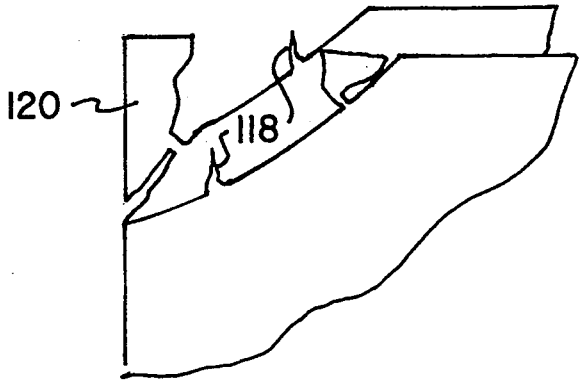
FIG. 6c (PRIOR ART)

Nevertheless, this may also lead to the bag tearing in an unclean manner because the upwardly pointing tit connections 116 may leave unsightly tails 118. FIG. 6*c* demonstrates what may happen if the rip does not follow the perforation but instead severs outwardly across the tab. Large, unsightly portions 120 of the tab stay attached to the bag.

For purposes of comparison, one may test the cleanness of the tear along the perforations by pulling each tested bag with minimum force of about five pounds maximum at the tit connection at the bag mouth of the bag body. The result of such a comparison test is set forth in the following Table III. Failures are listed for only those connections which induced a straight line tear, as opposed to a general tendency to want to tear or divert stress into the body of the bag at the tit connection location. At least every other tit connection on five different types of prior art bags having visible "standard" perforation tit connections (FIG. 5*a*) were tested. Also, three different bags with "upwardly pointing tit connections" (FIG. 6*a*) were also tested. Finally, four types of bags with wave pattern perforated connections in accordance with the present invention (FIGS. 3–4) were tested.

TABLE III

| TEST # | DESCRIPTION | # OF ATTEMPTS | # OF FAILURES |
|---|---|---|---|
| Standard tit connections: | | | |
| A. | #20 dual tab Bottlesack bag | 12 | 6 |
| B. | Walgreens 10 × 3 × 17 | 25 | 10 |
| C. | *Walgreens 6 × 3 × 12 | 23 | 0 |
| D. | *Walgreens 6 × 3 × 12 | 21 | 13 |
| E. | #12 dual tab Bottlesack bag | 12 | 2 |
| | Totals | 94 | 32 |
| | | 33% failures | |
| Upwardly point tit connections: | | | |
| F. | #12 Bottlesack bag | 12 | 0 |
| G. | 11.5 × 4 × 21 Sears Bag | 12 | 3 |
| H. | * 17 × 7.5 × 24 Sears Bag | 12 | 1 |
| | Totals | 36 | 4 |
| | | 11% failures | |
| Wave pattern connections: | | | |
| I. | Walgreens #12 | 16 | 0 |
| J. | Walgreens #12 | 16 | 0 |
| K. | #2 Bottlesack | 16 | 0 |
| L. | Safeway 1/6 Bbl sack | 8 | 0 |
| | Totals | 54 | 0 |
| | | 0% failures | |

* These two identical Walgreens bags were removed from the same wicket. The first (C) was from the bottom of the wicket and the second (D) was from the top of the wicket. Since the perforation cut is deeper at the top, the tit connections were more pronounced, hence the potential of tear was decidedly greater.

The upwardly pointing tit connections (FIG. 6*a*) surprisingly had three failures. This was due to the upwardly pointing tit connections, at times, creating a slight downwardly pointing dimple which caused tearing in response to stress, albeit far less frequently than the standard connections (FIG. 5*a*). To form the upwardly pointing tit connection, the die cut piece has to be bent to point severely upwards.

The wave pattern bags had no failures. They were less likely to tear than the "upwardly pointing tit connections" type in that they do not have to tear upwards to work. Wave pattern tit connections were found to tear far more cleanly and the cleaner cut is more pleasing aesthetically.

The previous embodiments have shown a stack of plastic bags contained within the carton. However, the carton may contain a different stack of items to be dispensed such as plastic sheet pick-up tissue typically used in bakeries or supermarkets for handling baked goods for customers, plastic sandwich and meat wrap in delis, or flower wraps.

While the foregoing description and drawings represent the preferred embodiments of the present invention, it will be understood that various changes and modifications may be made without departing from the spirit and scope of the present invention.

What is claimed is:

1. A plastic bag comprising:

a body having a mouth, a tail end, and opposite sides extending between the mouth and the tail end, the body being composed of a plastic material and opening at the mouth; and edge configurations each extending from a mouth edge to a respective one of the sides such that the mouth edge extends by a distance which is less than a width of the body between the opposite sides, the edge configurations each having a wave pattern comprising a plurality of peaks and valleys, at least some of said peaks and valleys being closer to said tail end than are at least some neighboring ones of said peaks and valleys.

2. A bag as in claim 1, wherein the wave pattern resembles any one of a saw tooth pattern, a sinusoidal pattern and a scalloped pattern.

3. A plastic bag comprising:

a body having a mouth, a tail end, and opposite sides extending between the mouth and the tail end, the body being composed of a plastic material and opening at the mouth;

edge configurations each extending from a mouth edge to a respective one of the sides such that the mouth edge is between the edge configurations and extends by a distance which is less than a width of the body between the opposite sides, the edge configurations each having a wave pattern comprising a plurality of peaks and valleys; and two tabs each extending from a respective one of said edge configurations such that the wave pattern includes perforations which define a boundary of said tabs and extend from said edge configurations to respective ones of said sides.

The bags may be secured to two tabs which are connected to the corner regions via the wave pattern, which is perforated. By attaching the tabs to a carton and pulling the bag, the bag severs cleanly from the tabs at the waveform perforation.

4. A bag as in claim 3, wherein the wave pattern resembles any one of a saw tooth pattern, a sinusoidal pattern and a scalloped pattern.

* * * * *